US011952738B2

(12) United States Patent
Linden et al.

(10) Patent No.: US 11,952,738 B2
(45) Date of Patent: Apr. 9, 2024

(54) ATTACHMENT COUPLER

(71) Applicant: Great Plains Manufacturing, Inc., Salina, KS (US)

(72) Inventors: Ethan Linden, Salina, KS (US); James Allen, Lawrence, KS (US)

(73) Assignee: Great Plains Manufacturing, Inc., Salina, KS (US)

( * ) Notice: Subject to any disclaimer, the term of this patent is extended or adjusted under 35 U.S.C. 154(b) by 74 days.

(21) Appl. No.: 17/479,782

(22) Filed: Sep. 20, 2021

(65) Prior Publication Data

US 2022/0090346 A1 Mar. 24, 2022

Related U.S. Application Data

(60) Provisional application No. 63/080,084, filed on Sep. 18, 2020.

(51) Int. Cl.
*E02F 3/36* (2006.01)

(52) U.S. Cl.
CPC ..... *E02F 3/3622* (2013.01); *E02F 3/3663* (2013.01)

(58) Field of Classification Search
None
See application file for complete search history.

(56) References Cited

U.S. PATENT DOCUMENTS 5,125,788 A 6/1992 Stenger
5,382,110 A 1/1995 Perotto
5,546,683 A 8/1996 Clark
5,890,871 A 4/1999 Woerman
6,123,501 A 9/2000 Pisco
6,231,296 B1 5/2001 Blomgren
6,241,455 B1 6/2001 Schupback et al.
6,332,747 B1 12/2001 Lee
6,385,872 B1 5/2002 Mieger et al.
6,487,800 B1 12/2002 Evans et al.
6,513,268 B2 2/2003 Lee et al.
6,658,770 B2 12/2003 Heiple
6,659,708 B2 12/2003 Heiple
7,014,385 B2 3/2006 Lim et al.
7,032,335 B2 4/2006 Short
7,198,451 B2 4/2007 Wimmer
7,426,796 B2 * 9/2008 Cunningham ..... E02F 3/3618 37/234
7,654,019 B2 2/2010 Yeager et al.
(Continued)

OTHER PUBLICATIONS

JP-2000104276-A (DOI, published Apr. 2000) all pages, especially figure 5. (Year: 2000).*

*Primary Examiner* — Michael S Lowe
(74) *Attorney, Agent, or Firm* — Hovey Williams LLP; Kameron D. Kelly

(57) ABSTRACT

A coupler for releasably coupling an attachment to a heavy-equipment machine. The coupler comprises a frame, and a plurality of connection elements extending from the frame, with the connection elements configured to engage with the attachment. The coupler additionally comprises a locking pin configured to extend simultaneously through the frame and the attachment. The coupler further comprises a locking element configured to selectively engage with the locking pin to securely couple the coupler to the attachment. The coupler further comprises an actuator configured to shift the locking element between an unlocked position and a locked position.

20 Claims, 8 Drawing Sheets

(56) References Cited

U.S. PATENT DOCUMENTS

| | | | | |
|---|---|---|---|---|
| 7,690,880 | B2 | 4/2010 | Honeyman et al. | |
| 7,866,935 | B1 | 1/2011 | Wilt et al. | |
| 7,963,716 | B2 | 6/2011 | Yamasaki | |
| 8,007,197 | B2 | 8/2011 | Nye et al. | |
| 8,469,623 | B2 | 6/2013 | Luyendijk et al. | |
| 8,684,623 | B2 | 4/2014 | Robl et al. | |
| 9,970,177 | B2 * | 5/2018 | Koestler | E02F 3/365 |
| 11,702,816 | B2 * | 7/2023 | Anderson | E02F 3/3622 37/468 |
| 2005/0214105 | A1 * | 9/2005 | Steig | E02F 3/3618 414/723 |

* cited by examiner

ATTACHMENT COUPLER

CROSS-REFERENCE TO RELATED APPLICATION

The present non-provisional patent application claims priority benefit to U.S. Provisional Patent Application Ser. No. 63/080,084, filed Sep. 18, 2020, and entitled "HYDRAULIC COUPLER." The entirety of the above-identified provisional patent application is hereby incorporated by reference into the present non-provisional patent application.

FIELD OF THE INVENTION

The present invention is related to the field of attachments for heavy-equipment machines. More specifically, the present invention is related to a coupler configured to connect an attachment with a heavy-equipment machine.

DESCRIPTION OF RELATED ART

Heavy-equipment machines, such as backhoes and excavators (referred to herein as "excavators"), commonly use attachments to perform various tasks. For instance, an excavator may use a bucket to collect (e.g., scoop or dig), transport, and release (e.g., dump) material such as dirt, rock, etc. Such buckets are generally connected to a distal end of an arm of the excavator via a coupler. Once connected to the excavator arm, the operator of the excavator can move the bucket to a particular position via movement of the excavator's arm. The coupler will also commonly connect the bucket to an actuator linkage associated with the excavator arm so as to permit the bucket to tilt, such as may be required for collecting and dumping material.

Previously-used couplers generally required an operator to manually connect the bucket to the arm of the excavator, such as by manually manipulating pins, locks, or other similar components of the previously-used couplers. Such manual manipulation is time consuming and generally requires the operator to leave the cab of the excavator to connect and disconnect the bucket to the excavator.

SUMMARY

To address the above-described challenges encountered with previously-used multipurpose buckets, embodiments of the present invention comprise a coupler for releasably coupling an attachment to a heavy-equipment machine. The coupler comprises a frame, and a plurality of connection elements extending from the frame, with the connection elements configured to engage with the attachment. The coupler additionally comprises a locking pin configured to extend simultaneously through the frame and the attachment. The coupler further comprises a locking element configured to selectively engage with the locking pin to securely couple the coupler to the attachment. The coupler further comprises an actuator configured to shift the locking element between an unlocked position and a locked position.

Embodiments of the present invention additionally include a method of coupling an attachment to a heavy-equipment machine. The method comprises a number of steps, including providing a coupler comprising a frame, a plurality of connection elements extending from the frame, a locking pin, a locking element, and an actuator. An additional step includes shifting the locking element to an unlocked position. An additional step includes engaging the frame with the attachment. During such engaging step, (i) the connection elements are engaged with the attachment, and (ii) the frame is positioned over the locking pin. A further step includes shifting the locking element to a locked position. After the locking element has been shifted to the locked position, the locking element is engaged with the locking pin.

Beneficially, the above-described coupler and method permits an attachment to be securely coupled and decoupled to/from a heavy-equipment machine via commands provided by an operator of the machine while positioned within a cab of the machine. As such, the operator is not required to leave the cab of the heavy-equipment machine to manually connect and disconnect the attachment to/from the machine.

BRIEF DESCRIPTION OF THE DRAWINGS

Embodiments of the present invention are described in detail below with reference to the attached drawing figures, wherein.

Figure 1:
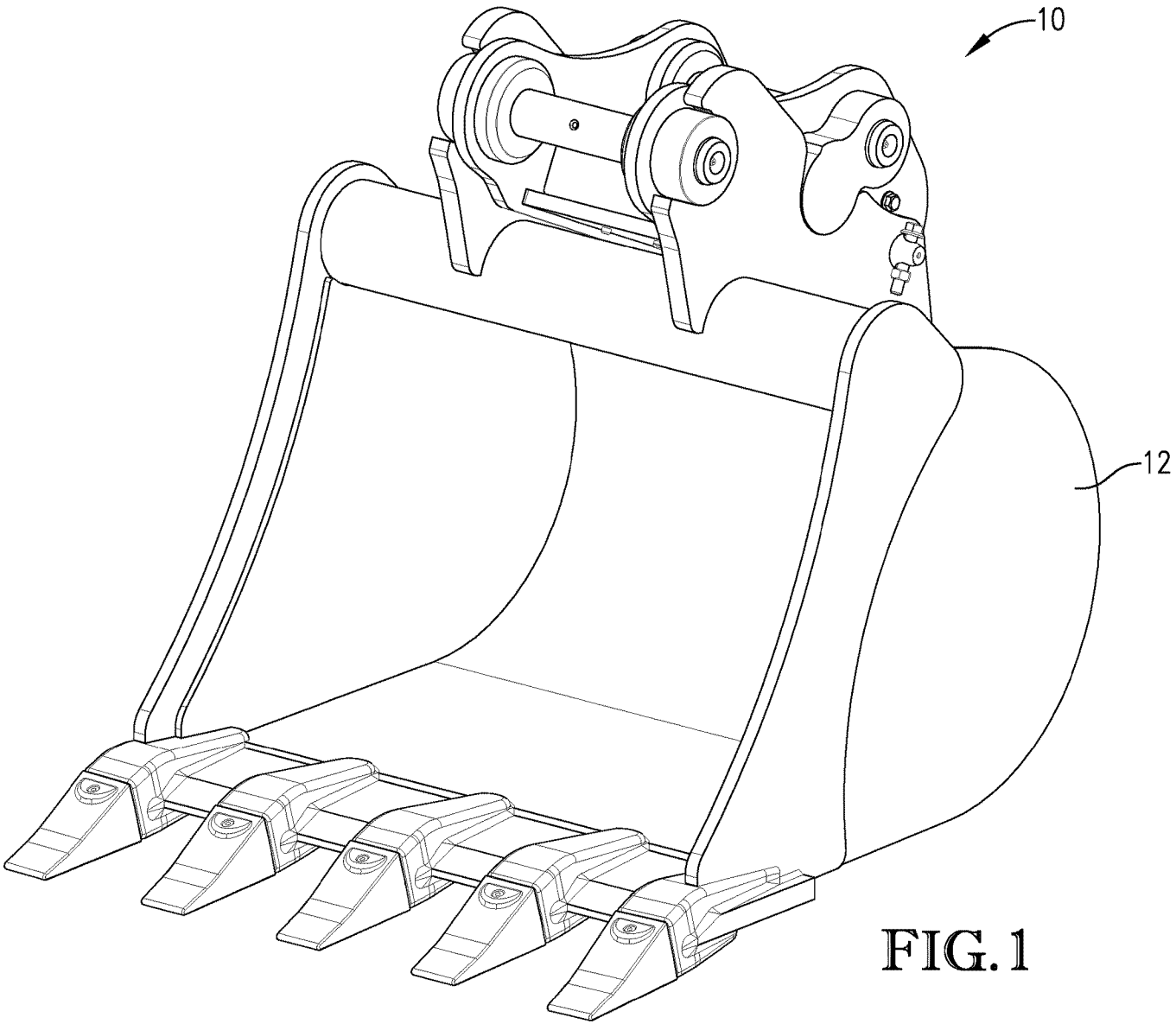
FIG. 1 is a front perspective view of an attachment engaged with a coupler according to embodiments of the present invention.

The figures are not intended to limit the present invention to the specific embodiments they depict. While the drawings do not necessarily provide exact dimensions or tolerances for the illustrated structures or components, the drawings are to scale with respect to the relationships between the components of the structures illustrated in the drawings.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 2:
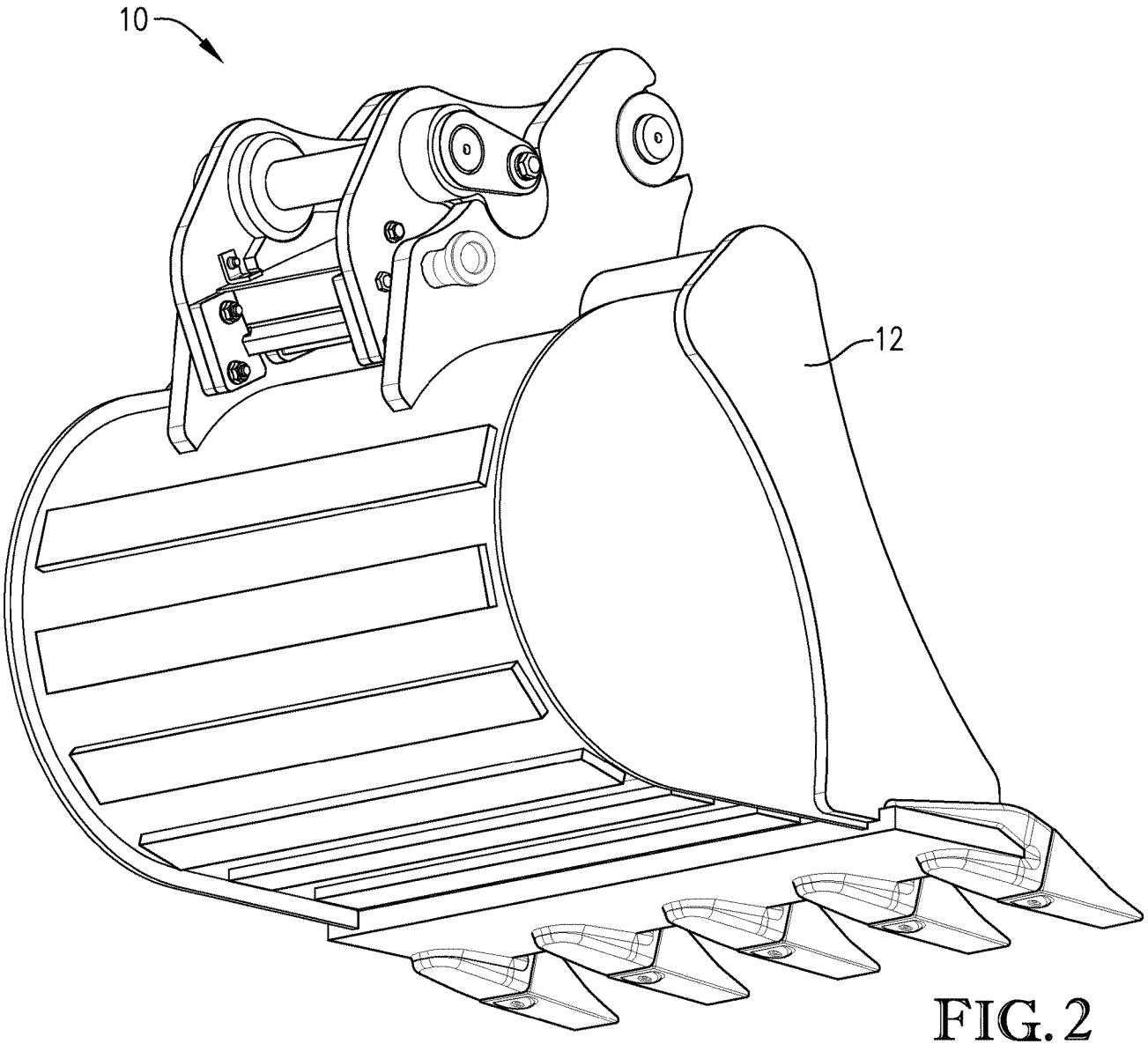
FIG. 2 is a rear perspective view of the attachment and coupler from FIG. 1.

With reference to the drawings, embodiments of the present invention are directed to a coupler 10, as illustrated in FIGS. 1 and 2, configured to operably connect an attachment/implement/tool, such as a bucket 12, with a heavy-equipment machine. In some embodiments, the coupler 10 may be hydraulically operated. However, embodiments contemplates that the coupler 10 may be operated by other types of power, such as by electrical, pneumatic, or mechanical power (e.g., rotary power). Regardless, the coupler 10 will generally be configured to selectively connect the bucket 12, or other attachment/implement/tool, to a heavy-equipment machine.

As mentioned above, in some specific embodiments, the attachment will comprise a bucket, such as bucket 12 illustrated in the figures. In addition, the heavy-equipment machine may comprise an excavator, such as may include an elongated arm 14 (see, e.g., FIG. 3) and/or associated linkage element 16. As such, the coupler 10 is configured to operably connect the bucket 12 to the arm 14 and/or the linkage element 16 of the excavator. The arm 14 of the excavator is generally configured to move the bucket 12 around the work area. The linkage element 16 may be configured to tilt the bucket 12, such as may be required to pick up and deposit material (e.g., scoop and dump soil or rock). Regardless, it should be understood that in other embodiments, the coupler 10 may connect various other types of attachments (e.g., augers, compactors, grapples, rakes, ripper, hammers, saws, etc.) to various other types of heavy-equipment machines (e.g., loaders, skid-steers, tractors, etc.).

As used herein, directional references describe directions from a perspective of the coupler 10 being engaged with the bucket 12, as shown in FIGS. 1 and 2, and with the open cavity of the bucket 12 facing a forward direction. As such, FIG. 1 illustrates front or forward portions of the coupler 10 and/or bucket 12. Correspondingly, FIG. 2 illustrates back or rearward portions of the coupler 10 and/or bucket 12.

Figure 3:
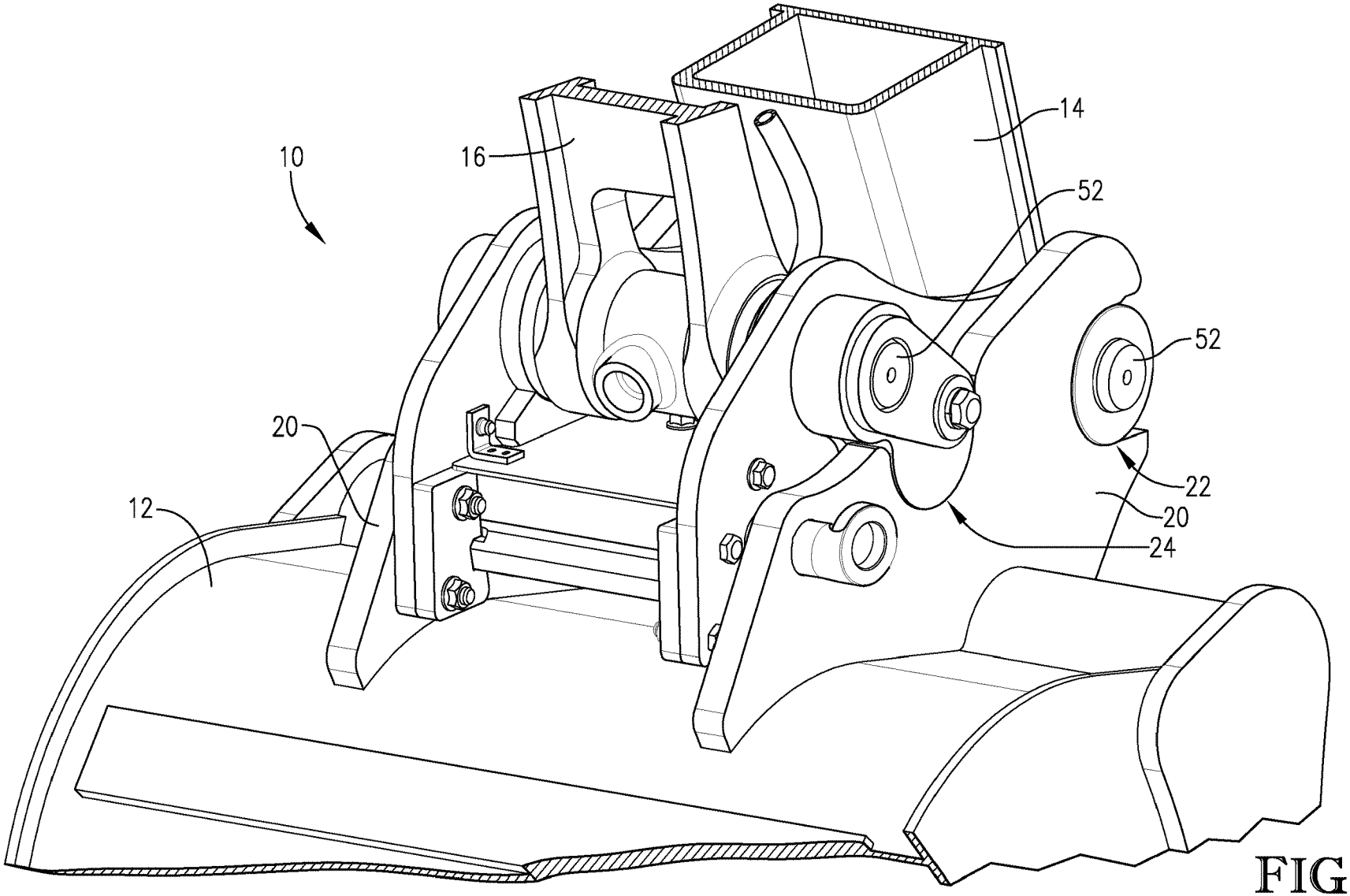
FIG. 3 is a rear perspective view of an attachment and a heavy-equipment machine inter-engaged via a coupler according to embodiments of the present invention, with portions of the attachment and the heavy-equipment machine cut away to illustrate the coupler in more detail.

With reference to FIG. 3, to facilitate coupling of the coupler 10 with the bucket 12, the bucket 12 (or other attachment) will generally include a connection assembly comprising a pair of spaced apart connection plates 20 that extend upward from a top of the bucket 12. Although only one of the connection plates 20 is illustrated in FIG. 3, the other connection plate 20 is generally formed the same as the connection plate 20 shown in FIG. 3 (see, e.g., FIG. 1). In more detail, each of the connection plates 20 will include connection elements, such as hooks, configured to receive components of the coupler 10 in a manner described in more detail below. For example, the connection plates 20 may include a pair of front coupling hooks 22 and a pair of rear coupling hooks 24. Each of the front and rear coupling hooks 22, 24 may comprise notches, grooves, or indentations formed in the connection plates 20. The front coupling hooks 22 may open in a forward direction, while the rear coupling hooks 24 may open in an upward direction. As described in more detail below, the coupler 10 may include connection elements, such as bosses or projections/protrusions, configured to engage with the coupling hooks 22, 24 of the bucket 12.

Figure 4:
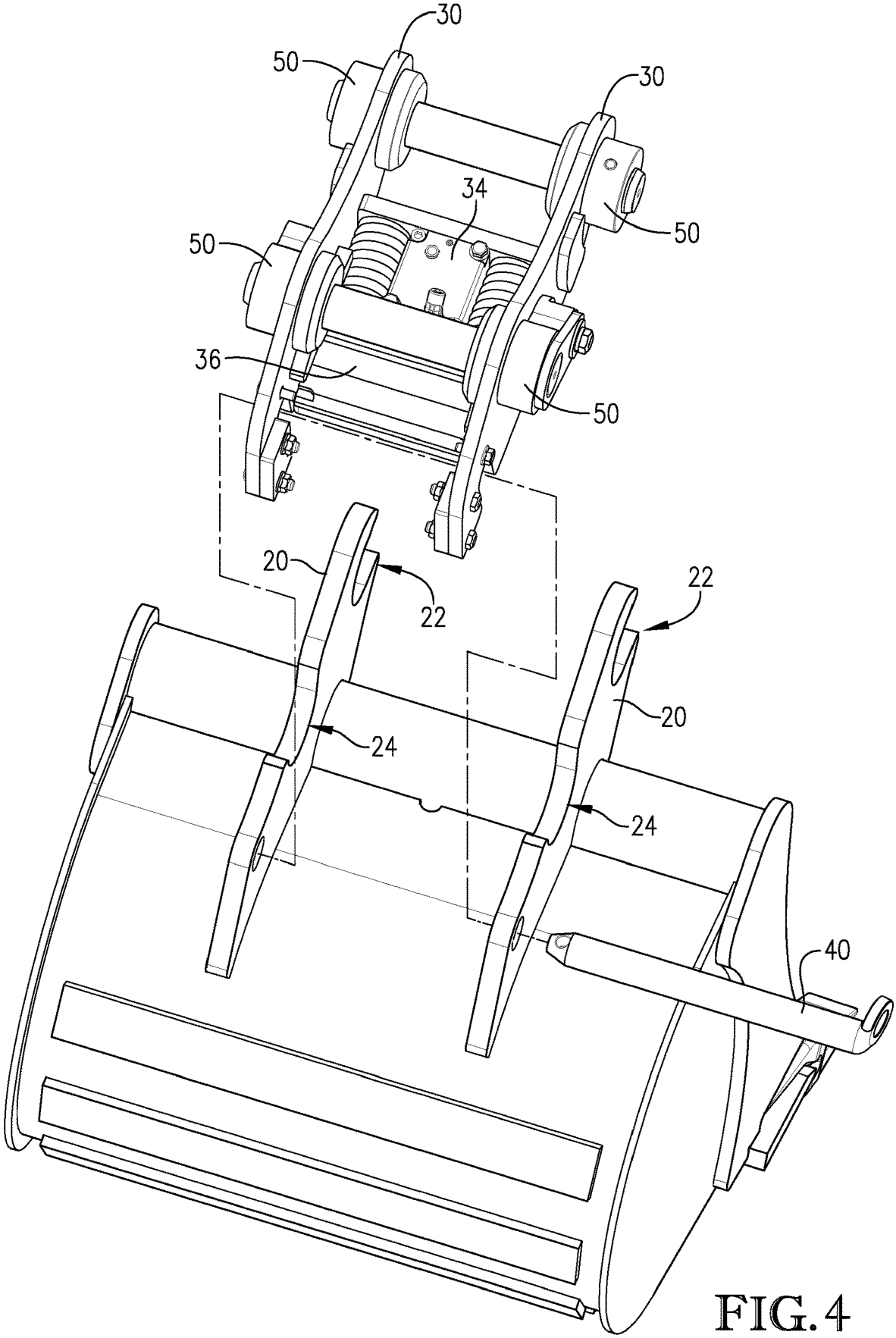
FIG. 4 is a top perspective view of the attachment and coupler from FIGS. 1 and 2, with the coupler separated from the attachment.
Figure 5:
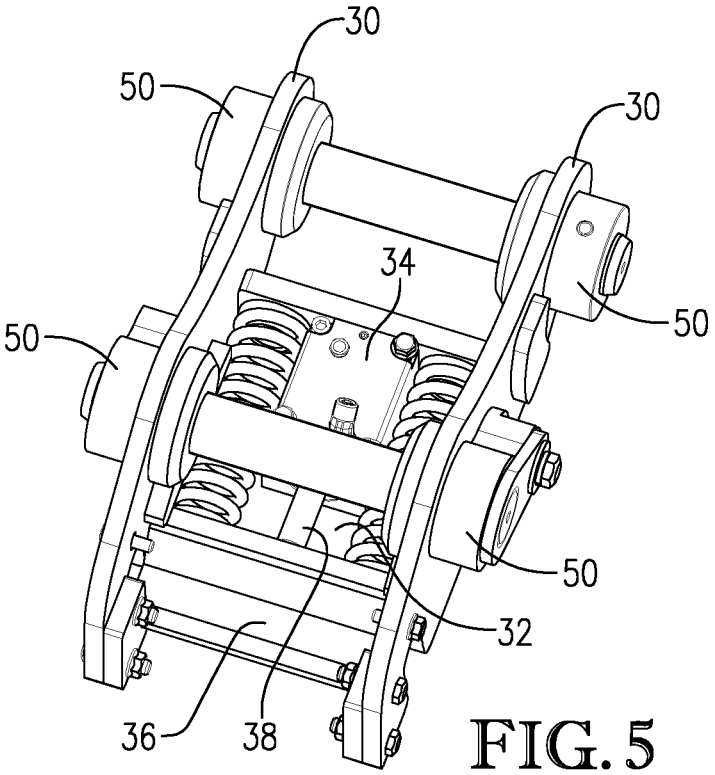
FIG. 5 is a top perspective view of the coupler from FIGS. 1 and 2.
Figure 6:
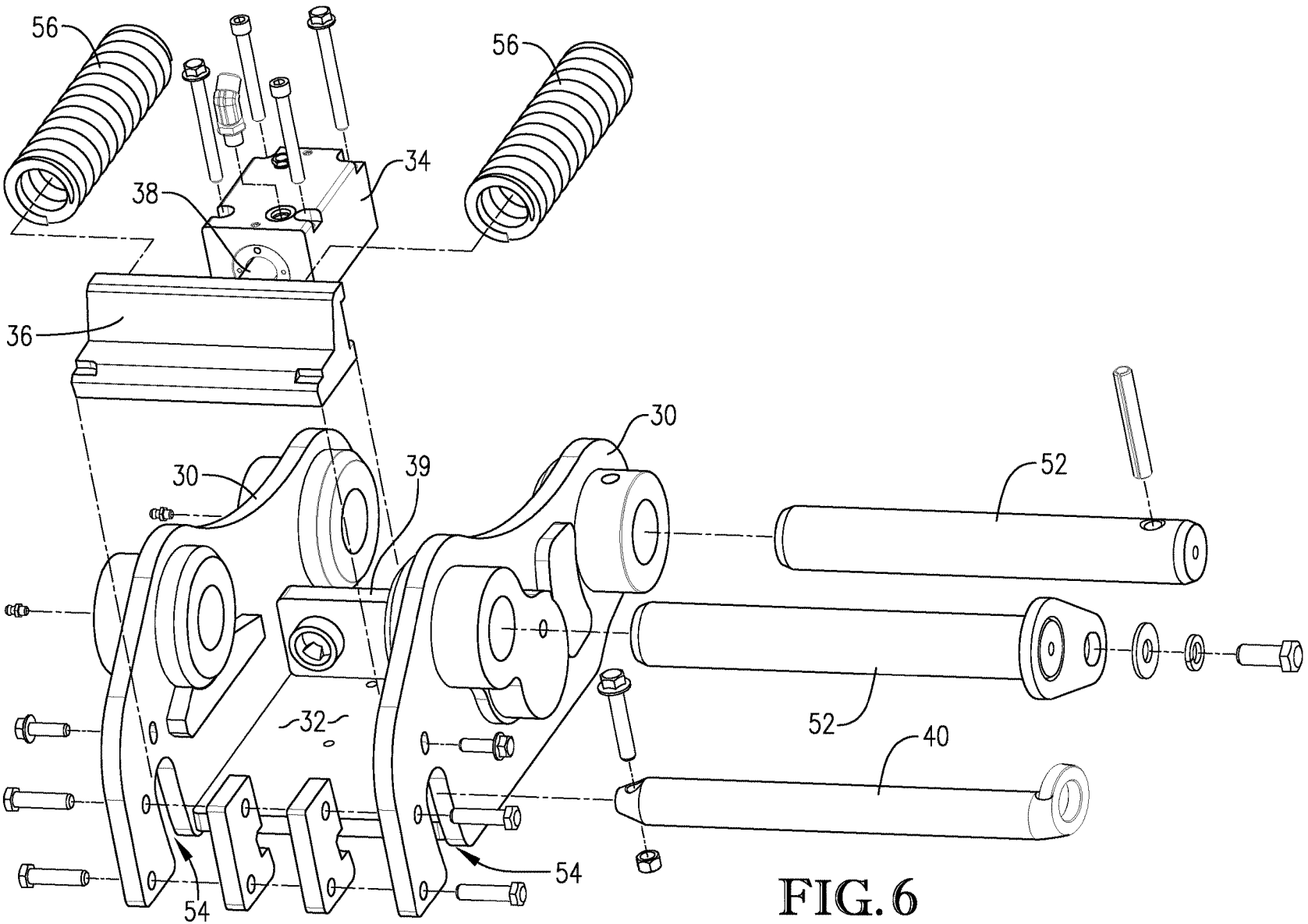
FIG. 6 is an exploded view of the coupler from FIG. 5.
Figure 7:
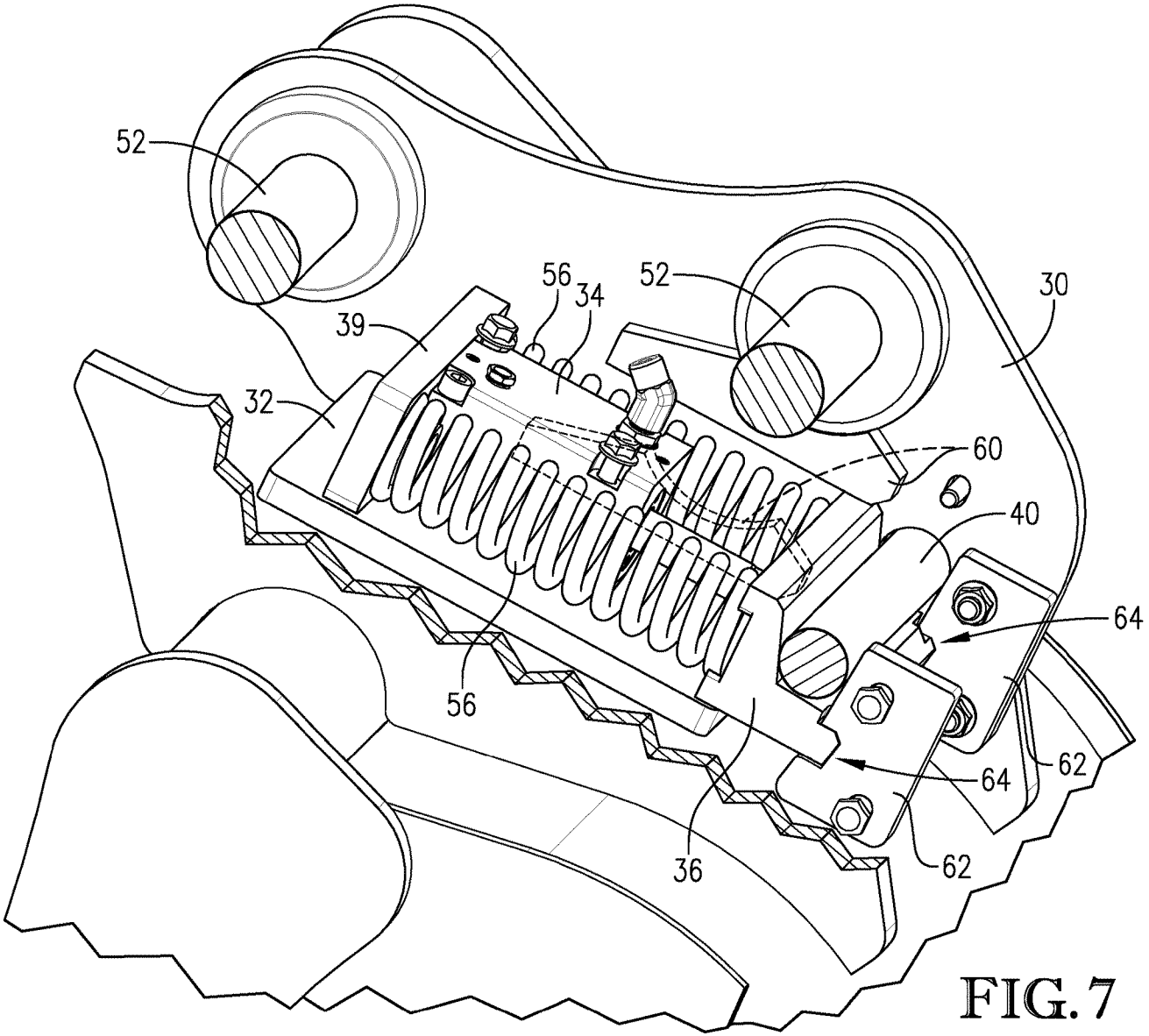
FIG. 7 is a side perspective view of the attachment and coupler from FIGS. 1 and 2, with portions of the coupler and the attachment cut away to illustrate the coupler in a locked configuration.
Figure 8:
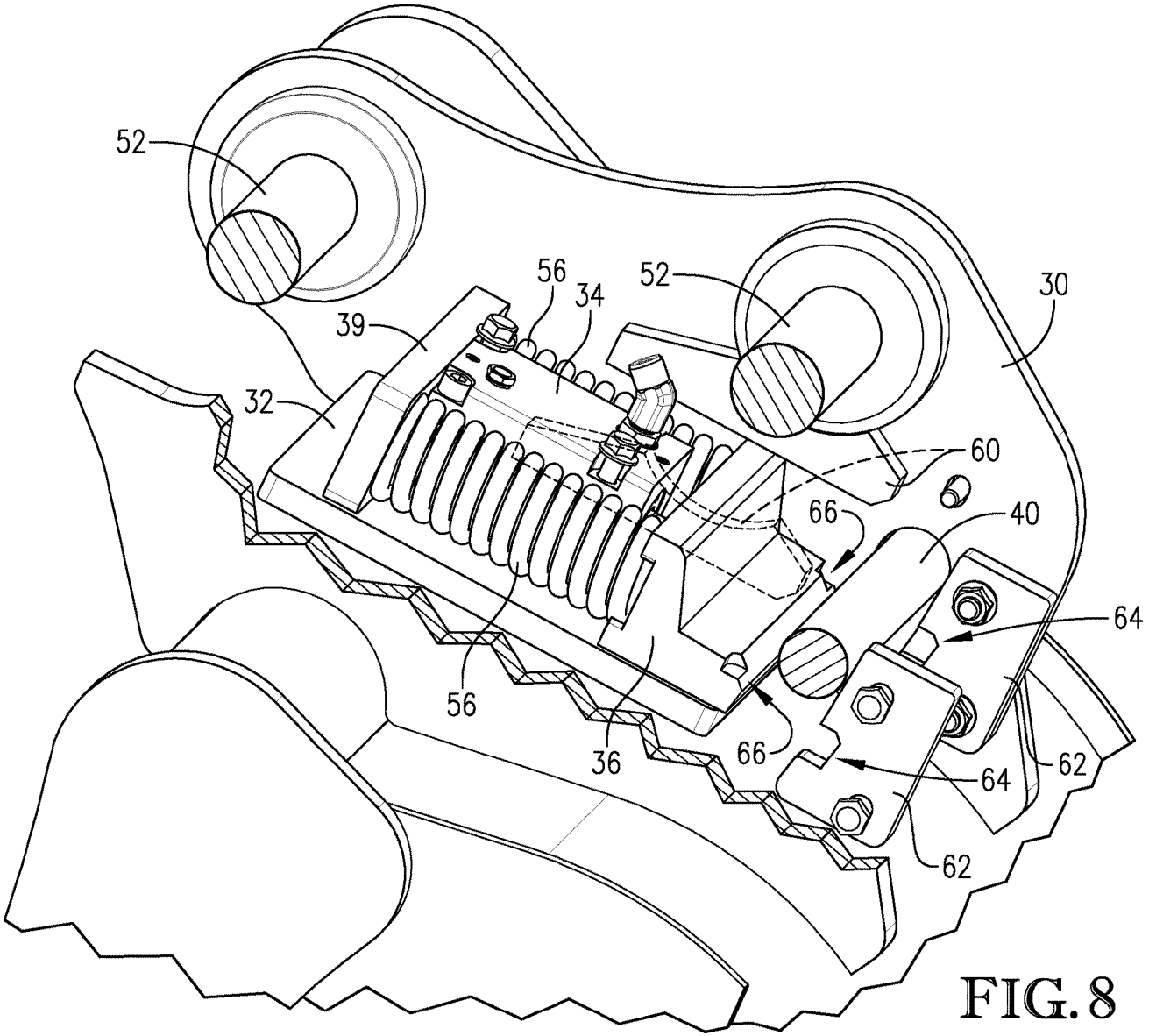
FIG. 8 is a side perspective view of the attachment and coupler from FIG. 7, illustrating the coupler in an unlocked configuration.

In more detail, as illustrated in FIGS. 4-6, the coupler 10 may comprises a pair of side plates 30 and a bottom plate 32 (see, e.g., FIGS. 5 and 6) that form a general frame of the coupler 10. The frame may be configured as a housing that supports an actuator 34 and a locking element 36. The locking element 36 may comprise a block of material that is formed in the shape of a wedge (as such, the locking element 36 may be referred to herein as a locking wedge 36). The actuator 34 may be coupled with the locking element 36 via a connection rod 38 or the like. Specifically, the locking element 36 may be positioned rearward of the actuator 34 and connected to the actuator 34 via the connection rod 38. As illustrated in FIG. 6, the actuator 34 may be secured to the frame of the coupler 10, such as secured to the bottom plate 32 via one or more fasteners. To further secure the actuator 34 in place, a support plate 39 may extend up from the bottom plate 32, as illustrated in FIGS. 6-8. A front side of the actuator 34 may abut up against the support plate 39, such that the support plate 39 acts as a base to prevent the actuator 34 from shifting forward during actuation of the locking element 36.

In view of the above, the actuator 34 is configured to selectively shift the locking element 36 rearward (i.e., away from the actuator 34) and forward (i.e., toward the actuator 34). When the actuator 34 shifts the locking element 36 rearward (or away from the actuator 34), the coupler 10 may be configured in a locked configuration in which the locking element 36 is securely engaged with a locking pin 40 of the coupler 10. The locking pin 40 is illustrated in FIGS. 4 and 6, and the coupler 10 positioned in the locked configuration is illustrated in FIG. 7. In contrast, when the actuator 34 shifts the locking element 36 forward (or towards from the actuator 34), the coupler 10 may be configured in an unlocked configuration in which the locking element 36 is disengaged with the locking pin 40 of the coupler 10. The coupler 10 positioned in the unlocked configuration is illustrated in FIG. 8. When the coupler 10 is in the unlocked configuration, the coupler 10 is free from attachment to the bucket 12, whereas when the coupler 10 is in the locked configuration, the coupler is securely coupled with the bucket 12 (e.g., for use of the bucket 12 by the heavy-equipment machine to which the coupler 10 is attached).

The actuator 34 may comprise various types of actuators, such as hydraulic actuators (e.g., hydraulic cylinders), pneumatic actuators, mechanical actuators, or electric actuators. In addition, the actuator 34 may comprise a linear actuator, rotary actuator, or any other type of actuator suitable to selectively shift the position of the locking element 36 into and out of engagement with the locking pin 40. Notably, control lines (e.g., wires, cables, or wireless communication links) may extend between the actuator 34 and a cab of the heavy-equipment machine (e.g., an excavator), such that an operator of the excavator can control the position of the actuator 34. Specifically, from the cab of the excavator, the operator may shift the actuator 34 (and thus the coupler 10) between locked and unlocked configurations.

Returning to FIG. 4, the coupler 10 may include a plurality of connection elements 50, such as bosses or projections/protrusions, positioned on exterior sides of the side plates 30, with such connection elements 50 configured to engage with the coupling hooks 22, 24 of the connection plates 20 of the bucket 12. For instance, a pair of front connection elements 50 may be configured to engage with the front coupling hooks 22 of the bucket 12, while a pair of rear connection elements 50 may be configured to couple with the rear coupling hooks 24 of the bucket 12. The coupler may additionally include a pair of connection pins 52, which facilitate connection of the coupler 10 with the heavy-equipment machine. Specifically, a front connection pin 52 may extend through the pair of front connection elements 50 of the coupler 10, as shown in FIGS. 4 and 6. Such front connection pin 52 may facilitate connection of the coupler 10 with the arm 14 of an excavator-type heavy-equipment machine (see, e.g., FIG. 3). Similarly, a rear connection pin 52 may extend through the pair of rear connection elements 50 of the coupler 10, as shown in FIGS. 4 and 6. Such rear connection pin 52 may facilitate connection of the coupler 10 with the linkage element 16 of the excavator-type heavy-equipment machine (see, e.g., FIG. 3).

As perhaps bests shown in FIG. 6, each of the side plates 30 of the coupler 10 may include a connection gap 54 located near rear portions of the side plates 30. Such connection gaps 54 allow the frame of the coupler 10 to be positioned over the locking pin 40 after the locking pin 40 has been inserted within through holes formed in the connection plates 20 of the bucket 12 (see, e.g., FIG. 3). Thus, the coupler 10 can be engaged with the bucket 12 by engaging the connection elements 50 of the coupler 10 with the coupling hooks 22, 24 of the bucket 12, and furthermore, the connection gaps 54 are positioned over the locking pin 40 (once the locking pin 40 has been engaged with the bucket 12). In general, such engagement will be accomplished with the coupler 10 in the unlocked configuration (i.e., with the locking element 36 retracted towards the actuator 34). Once the frame of the coupler 10 is engaged with the bucket 12, the coupler 10 can be transitioned from the unlocked configuration to the locked configuration (i.e., with the locking element 36 extended away from the actuator 34 and into engagement with the locking pin 40). When the coupler 10 is in the locked configuration, the coupler 10 is prevented from being disengaged from the bucket 12. In contrast, when the hydraulic coupler 10 is in the unlocked configuration, the coupler 10 can be freely disengaged from the bucket 12.

Specifically, in the unlocked configuration (see, e.g., FIG. 8), the actuator 34 retracts the locking element 36 from underneath the locking pin 40 (i.e., shifts the locking element 36 forward), so as to free the coupler 10 from the bucket 12 and to permit the coupler 10 to be disengaged and raised away from the bucket 12. In contrast, while in the locked position (see, e.g., FIG. 7), the locking element 36 is engaged with (i.e., positioned underneath) the locking pin 40 so as to prevent the coupler 10 from being disengaged from the bucket 12. In particular, when the locking pin 40 is simultaneously engaged with both the coupler 10 and the bucket 12, the locking element 36 can be positioned underneath the locking pin 40 so as prevent the coupler 10 from being lifted away from the bucket 12. The coupler 10 can be shifted from the unlocked configuration to the locked configuration by the actuator 34 extending the locking element 36 rearward underneath the locking pin 40. In some embodiments, the coupler 10 may include one or more biasing elements 56 biasing the locking element 36 rearward towards the locked configuration. For example, the biasing elements 56 may comprise springs that extend between the support plate 39 and the locking element 36.

Turning to the operation of the coupler 10 in more detail, the coupler 10 will initially be connected to the heavy-equipment machine (e.g., an excavator). Specifically, the arm 14 of the excavator will be aligned with the coupler 10 such that a forward connection pin 52 can be simultaneously inserted through the coupler 10 and the excavator arm 14. In addition, the actuator linkage 16 of the excavator will be aligned with the coupler 10 such that the rear connection pin 52 can be simultaneously inserted through the coupler 10 and the actuator linkage 16. As such, the coupler 10 will be securely coupled with the excavator, as illustrated in FIG. 3.

To facilitate connection of the bucket 12 with the coupler 10 and the excavator, the locking pin 40 of the coupler 10 will be initially inserted within the through holes formed in the connection plates 20 of the bucket 12 (see, e.g., FIG. 4). In such a configuration, the excavator operator can position the coupler 10 (which is attached to the end of the excavator arm 14 and linkage 16) into alignment with the bucket 12 so as to facilitate coupling of the bucket 12 with the excavator. As an initial step, the operator may shift (e.g., from inside the cab of the excavator) the coupler 10 to the unlocked configuration such that the locking element 36 is retracted by the actuator 34 forward against the biasing elements 56. As such, the excavator operator can move the excavator arm 14 and/or linkage 16 such that the front connection elements 50 of the coupler 10 are received within the front coupling hooks 22 of the bucket 12. Next, the operator can move excavator arm 14 and/or linkage 16 such that the rear connection elements 50 of the coupler 10 are received within the rear coupling hooks 24 of the bucket 12. During such engagement between the connection elements 50 and the coupling hooks 22, 24, a rearward portion of the coupler 10 will be lowered around the locking pin 40 (which was previously inserted into engagement with the bucket 12). Specifically, the coupler 10 will be lowered such that the connection gaps 54 formed in the side plates 30 pass around and receive the locking pin 40. As such, the locking pin 40 is simultaneously inserted through the frame of the coupler 10 and the bucket 12.

In such a relative position between the coupler 10 and the bucket 12 (i.e., as shown in FIG. 8), the actuator 34 of the coupler 10 can be used to shift the locking element 36 rearward into a locked position. Specifically, the actuator 34 can shift the locking element 36 rearward into engagement with (e.g., at least partly below) the locking pin 40. In some embodiments, the biasing elements 56 will function to assist with maintaining the locking element 36 in the locked position. Regardless, with the locking element 36 positioned in the locked position, i.e., below or otherwise engaged with the locking pin 40 (see, e.g., FIG. 7), the coupler 10 will be in a locked configuration, providing a secure coupling between the bucket 12 and the excavator. Beneficially, such a connection can be made without the operator being required to leave the cab of the excavator. Specifically, the operator can use a control mechanism (e.g., joysticks, buttons, or other similar control elements operably connected to the excavator's hydraulic system, electric system, pneumatic system, mechanical system, etc.) within the excavator cab to control the position of the actuator 34 of the coupler 10 so as to transition the coupler 10 between locked and unlocked configurations. The operator is only required to manually insert the locking pin 40 into engagement with the bucket 12. However, such insertion can be performed at any time, and the locking pin 40 can thereafter remain engaged with the bucket 12. The above-described steps can be performed in a reverse order to decouple the bucket 12 from the excavator without the operator needing to leave the cab.

To aid in proper motion and alignment of the locking element 36 as it shifts between the locked and unlocked positions, the coupler 10 may include various alignment mechanisms. For example, as shown in FIGS. 7 and 8, the interior surface of each of the side plates 30 of the coupler 10 may include runner guides 60 that securely position the locking element 36 between the runner guides 60 and the bottom plate 32 of the coupler 10 as the locking element 36 is extended and retracted (i.e., between the locked and unlocked positions). As such, the locking element 36 may translate generally linearly (i.e., under power from the actuator 34) between the unlocked position and the locked position (and vice versa). In addition, rearward portions of each of the side plates 30 of the coupler 10 may include receiving elements 62, which may comprise plates with alignment notches 64 formed therein. Correspondingly, the rearward end of the locking element 36 may include alignment grooves 66 formed on either or both lateral sides (see, e.g., FIG. 8), with such alignment grooves 66 shaped to mate with the alignment notches 64 formed on the receiving elements 62, as shown in FIG. 7. As such, when the locking element 36 is extended to the locked position (i.e., into engagement with and/or below the locking pin 40), the locking element 36 will be properly aligned and supported in place via the engagement between the alignment grooves 66 of the locking element 36 and the alignment notches 64 of the receiving elements 62.

It should be understood that in some embodiments, the actuator 34 of the coupler 10 may comprise a "single acting" linear actuator/cylinder. As such, forcing hydraulic fluid into the actuator 34 will retract the locking element 36 so as to place the coupler 10 in the unlocked configuration (i.e., retract the locking element 36 from engagement with the locking pin 40). In contrast, relieving fluid from the actuator 34 may place the coupler 10 in the locked configuration (i.e., extends the locking element 36 into engagement with and/or below the locking pin 40) via the force of the biasing elements 56. Specifically, such biasing elements 56 can operate to force the hydraulic fluid out of actuator 34, so as to allow the locking element 36 to be extended into engagement with the locking pin 40.

Although the invention has been described with reference to the one or more embodiments illustrated in the figures, it is understood that equivalents may be employed, and substitutions made herein without departing from the scope of the invention as recited in the claims.

What is claimed is:

1. A coupler for releasably coupling an attachment to a heavy-equipment machine, said coupler comprising:

a frame comprising a pair of spaced apart sides and a bottom plate extending between said sides, wherein said frame further comprises a support plate extending from said bottom plate and between said sides;

a plurality of connection elements extending exteriorly from each of said sides said frame and configured to engage with the attachment;

a locking pin configured to extend simultaneously through said frame and the attachment, wherein said locking pin is removable from said frame and the attachment;

an elongated locking element extending between said sides of said frame and configured to selectively engage with said locking pin to securely couple said coupler to the attachment;

an actuator configured to shift said locking element between an unlocked position and a locked position, wherein said actuator is rigidly secured to said bottom plate of said frame and abuts said support plate, and wherein a rod extends from said actuator to said locking element; and a pair of biasing elements extending from said support plate to said locking element, with one biasing element positioned on each side of the actuator, configured to bias said locking element into engagement with said locking pin.

2. The coupler of claim 1, wherein said actuator comprises a linear actuator.

3. The coupler of claim 2, wherein said actuator comprises a hydraulic actuator.

4. The coupler of claim 2, wherein said actuator is configured to linearly actuate said locking element between the unlocked position and the locked position.

5. The coupler of claim 1, wherein said pair of spaced apart sides comprise a pair of side plates.

6. The coupler of claim 5, wherein said connection elements comprise bosses extending from exterior sides of said side plates.

7. The coupler of claim 5, wherein said locking element and said actuator are at least partially housed within said frame.

8. The coupler of claim 5, wherein interior surfaces of said side plates include runner guides for maintaining a position of said locking element as said locking element transitions between the locked and unlocked positions.

9. The coupler of claim 8, wherein the position of said locking element is maintained between said runner guides and said bottom plate of said frame.

10. The coupler of claim 1, wherein said locking element has a wedge shape.

11. The coupler of claim 1, wherein said biasing elements comprise springs.

12. The coupler of claim 1, wherein said actuator is configured to be controlled from inside a cab of the heavy-equipment machine.

13. The coupler of claim 1, wherein said heavy-equipment machine is an excavator, and wherein said attachment is a bucket.

14. A method of coupling an attachment to a heavy-equipment machine, said method comprising the steps of:

(a) providing a coupler comprising a frame including a pair of spaced apart sides, a bottom plate extending between the sides, and a support plate extending from the bottom plate and between said sides, wherein the coupler further comprises a plurality of connection elements extending exteriorly from each of the sides of the frame, a locking pin, a locking element, and an actuator, wherein the locking element is elongated and extends between the sides of the frame, and wherein the actuator is rigidly secured to the bottom plate of the frame and abuts the support plate, and wherein a rod extends from the actuator to the locking element, wherein the coupler further includes a pair of biasing elements extending from the support plate to the locking element, with one biasing element positioned on each side of the actuator, configured to bias said locking element into engagement with said locking pin;

(b) shifting the locking element, against the biasing elements, to an unlocked position;

(c) engaging the frame with the attachment, wherein during said engaging of step (c), (i) the connection elements are engaged with the attachment, and (ii) the frame is positioned over the locking pin; and (d) removably inserting the locking pin through the frame and the attachment;

(e) shifting the locking element to a locked position, wherein after the locking element has been shifted to the locked position in step (e), the locking element is engaged with the locking pin.

15. The method of claim 14, wherein said shifting of steps (b) and (e) is performed by the actuator.

16. The method of claim 14, wherein said shifting of steps (b) and (e) is controlled by an operator of the heavy-equipment machine from inside a cab of the heavy-equipment machine.

17. The method of claim 14, wherein during said shifting of steps (b) and (e), the locking element translates linearly.

18. The method of claim 14, wherein said actuator comprises a hydraulic linear actuator.

19. The method of claim 14, wherein the heavy-equipment machine is an excavator, and wherein the attachment is a bucket.

20. The coupler of claim 1, wherein each of the sides of the frame includes a receiving plate formed with a notch, and wherein when the locking element is shifted into the locked position, the locking element engages with said locking element and with the notches of the receiving plates.

* * * * *